United States Patent [19]

Jacobs et al.

[11] 4,168,099

[45] Sep. 18, 1979

[54] MULTI-POSITION EXAMINATION CHAIR

[75] Inventors: Thomas E. Jacobs, Ft. Loramie; Marvin A. Leeper, Versailles, both of Ohio; Terry J. Simpkins, Snowmass Village, Colo.

[73] Assignee: Midmark Corporation, Minster, Ohio

[21] Appl. No.: 890,310

[22] Filed: Mar. 27, 1978

[51] Int. Cl.[2] ..... A61G 15/00

[52] U.S. Cl. ..... 297/325; 297/330; 269/325

[58] Field of Search ..... 269/325, 324, 323; 297/330, 325; 5/62

[56] References Cited

U.S. PATENT DOCUMENTS

| | | | |
|---|---|---|---|
| 2,042,399 | 5/1936 | Holme | 269/325 |
| 3,041,120 | 6/1962 | Burzlaff | 269/325 |
| 3,206,188 | 9/1965 | Douglass | 269/325 |
| 3,241,828 | 3/1966 | Adolphson et al. | 269/325 |
| 3,578,379 | 5/1971 | Taylor et al. | 297/330 |
| 3,754,749 | 8/1973 | Lyon et al. | 269/325 |
| 3,806,109 | 4/1974 | Weber et al. | 269/323 |

*Primary Examiner*—Francis K. Zugel

*Attorney, Agent, or Firm*—Biebel, French & Nauman

[57] ABSTRACT

A multi-position examination chair for supporting a patient and assuming selected ones of a plurality of examination positions which permit a plurality of standard obstetric and gynecologic examinations to be performed upon the patient includes a base for providing support and a chair mounted on the base. The chair includes a plurality of movable chair portions which are movable with respect to each other. An hydraulic power arrangement is provided for moving each of the chair portions into desired relative positions such that the plurality of examination positions may be achieved. A plurality of switch means are provided, with each such switch means associated with a respective one of the examination positions. A control means is responsive to the plurality of switch means for controlling operation of the hydraulic power arrangement. Actuation of each of the switch means results in the chair portions moving into the examination position associated with the actuated switch means. The switch means may include a plurality of foot-actuated electrical switches.

6 Claims, 21 Drawing Figures

106
98
97
64
104
66
96
88
86
92
90
72
76
138
78
80
84
85
126
100
118
54
114
94
110
108
124
102
122
30
116
120
70
112
68
58
62
60
74
82
83
128
130
134
136
132

MULTI-POSITION EXAMINATION CHAIR

BACKGROUND OF THE INVENTION

The present invention relates to an examination chair for supporting a patient during obstetric and gynecologic examinations and, more particularly, to a chair which automatically assumes selected ones of a plurality of examination positions to permit a plurality of standard obstetric and gynecologic examinations to be performed upon the patient.

In the past gynecologic and obstetric examinations have generally been performed by a physician with the patient supported by a general purpose physician's table. Such a table has a high, flat, hard body support surface and a pair of metal stirrups on either side of the table top surface for receiving the patient's heels so that the pelvic region is exposed for examination. Such a table is extremely uncomfortable for the patient during the examination. Additionally, it is difficult for the patient to climb onto and off of the table surface and to assume the desired examination positions. This difficulty is, of course, heightened when the patient is pregnant. These physical discomforts have added to the mental discomfort and tension which many women experience in such an examination to make for a highly unpleasant experience.

During the course of an examination by a gynecologist or obstetrician, it may be desired to position the patient in a plurality of standard examination positions such as the lithotomy position and the Trendelenberg position. It may also be desirable to examine the patient with the patient in a flat prone position or to tilt the patient from the lithotomy position to a pelvic tilt position. With most standard prior art examination tables, it has been necessary for the physician to adjust manually the orientation of the examination table, the stirrups, and any movable portions of the table, in order to place the patient in the desired position. This is time consuming and requires substantial physical effort by the physician.

Several approaches have been taken toward providing an adjustable chair or table with a power assisted arrangement for adjusting the orientation of the chair and the patient. U.S. Pat. No. 3,845,945, issued Nov. 5, 1974, to Lawley, et al discloses an obstetric examination chair which is mechanized to tilt from a chair position backward into a reclining position. As the chair is tilted, there is no relative movement of the body support members of the chair, with the exception of lateral swinging of the leg supports outwardly, by a mechanical linkage, such that a lithotomy position is achieved. Thus the chair of Lawley, et al provides only for positioning the patient in a lithotomy position with a minimum of relative movement between the body support portions of the chair.

U.S. Pat. No. 3,318,596, issued May 9, 1967, to Herzog, discloses a surgical table having leg supports which are positioned by means of a motorized linkage arrangement. The leg supports may be pivoted upwardly, spread apart, or the entire frame may be moved laterally by actuation of several electric motors or, alternatively, by means of several hydraulic cylinders. The surgical table of Herzog does not assume a chair position and is, therefore, somewhat difficult for the patient to climb onto. Additionally, each of the motors or hydraulic cylinders must be individually controlled by the physician in order to position the patient.

U.S. Pat. No. 3,095,235, issued June 25, 1963, to Babcock, et al, discloses a hydraulically operated chair which may be converted into a bed. The hydraulic cylinders are connected to manually operated pumps.

U.S. Pat. No. 3,804,460, issued April 16, 1974, to Leffler, discloses a chair of the type used by a dentist, which may be oriented by means of several electric motors into desired positions. The chair may be shifted forwardly and rearwardly relative to a supporting base, as well as raised and lowered with respect to the base. Additionally, the chair may be reclined. Each of these functions must necessarily be individually controlled.

A need exists for a multi-position examination chair for supporting a patient to permit a plurality of standard obstetric and gynecologic examinations to be performed upon the patient, which chair assumes selected ones of a plurality of examination positions upon actuation of a corresponding one of a plurality of controls. Such a chair would simplify the examination procedure, reducing the patient's tension and, at the same time, facilitating the examination for the physician.

SUMMARY OF THE INVENTION

A multi-position examination chair for supporting a patient and assuming selected ones of a plurality of examination positions which permit a plurality of standard obstetric and gynecologic examinations to be performed on the patient includes a base means for providing support. A chair, mounted on the base means, includes a plurality of movable chair portions which are movable with respect to each other. Power means are provided for moving each of the chair portions into desired relative positions such that the plurality of examination positions may be achieved. A plurality of switch means are connected to a control means, with each such switch means being associated with a respective one of the plurality of examination positions. The control means controls operation of power means such that actuation of each of the switch means results in the chair portions moving into the examination position associated with the actuated switch means.

The chair may comprise a back portion, pivotally attached to the base means, an intermediate portion, pivotally attached to the back portion, and a seat portion, pivotally attached to the intermediate portion. The power means may comprise a plurality of hydraulic cylinders. A first cylinder means is connected between the base means and the back portion. A second cylinder means is connected between the intermediate portion and the back portion. A third cylinder means is connected between the intermediate portion and the seat portion.

Advantageously, the plurality of switch means may comprise a plurality of electrical foot-actuated switches.

Accordingly, it is an object of the present invention to provide an examination chair which automatically assumes one of a plurality of examination positions in response to actuation of an associated control; to provide such an examination chair including a plurality of chair sections which are movable with respect to each other; to provide such a chair in which power means are sequentially actuated to move the chair sections in a predetermined sequence to the desired examination position; to provide such a chair in which the lithotomy, Trendelenberg, and table positions may be achieved;

and, to provide such a chair in which the examinations positions may be achieved sequentially without returning the chair to its initial chair position.

BRIEF DESCRIPTION OF THE DRAWINGS

FIG. 18 is a view illustrating the manner in which FIGS. 17A–17C are to be assembled.

DETAILED DESCRIPTION OF THE PREFERRED EMBODIMENTS

Figure 1:
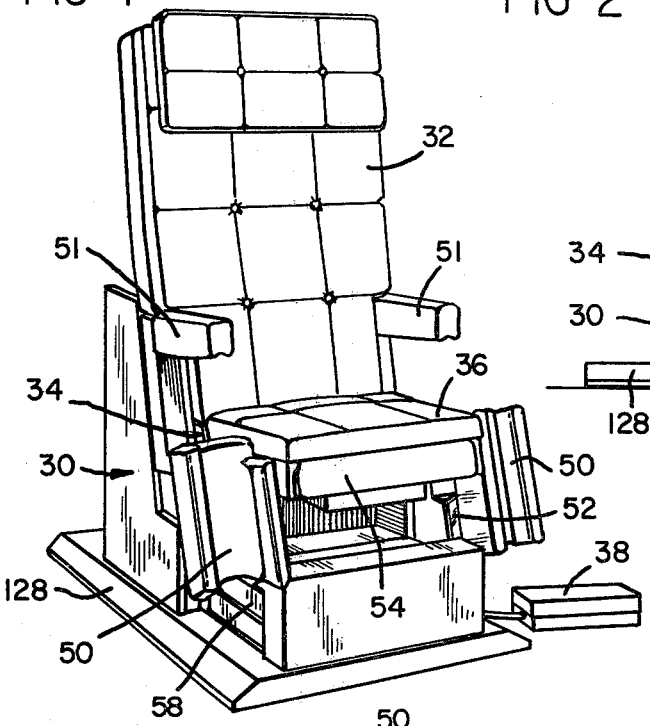
FIG. 1 is a perspective view of the multi-position examination chair of the present invention in the chair position.

Reference is made to FIGS. 1–9 which show the multi-position examination chair of the present invention and illustrate somewhat diagrammatically the manner in which the chair may assume various examination positions to position a patient such that a plurality of standard obstetric and gynecological examinations may be performed.

A base means 30 provides support for the chair which includes a plurality of chair portions which are movable with respect to each other. A back portion of the chair 32 is pivotally attached to the base 30; an intermediate portion 34 of the chair is pivotally attached to the back portion; and a seat portion 36 is pivotally attached to the intermediate portion 34. A plurality of power means, not seen in FIGS. 1–9, are provided for moving each of the chair portions into various positions such that the plurality of examination positions may be achieved.

Figure 7:
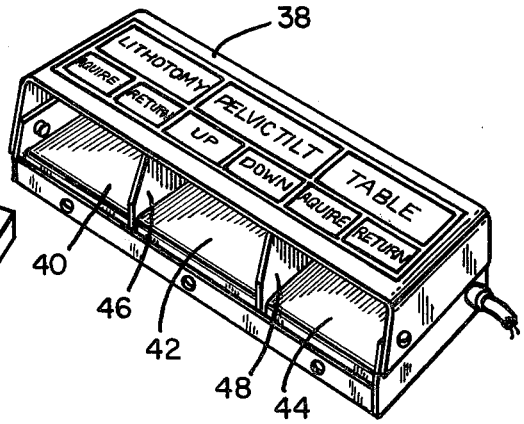
FIG. 7 is a perspective view of the foot-actuated switch control for controlling the position of the chair.

A foot-actuated control 38, illustrated in FIG. 7, includes a plurality of switch means. Each switch means is associated with respective one of the plurality of examination positions. The switch means within the control 38 are actuated by the operator by tilting pedals 40, 42, and 44 to the left or to the right. Dividers 46 and 48 separate the pedals and prevent the physician from accidentally actuating more than one switch simultaneously. A control means is responsive to the plurality of switch means for controlling operation of the power means such that actuation of each of the switch means results in the chair portions moving into the examination position associated with the actuated switch means.

Figure 2:
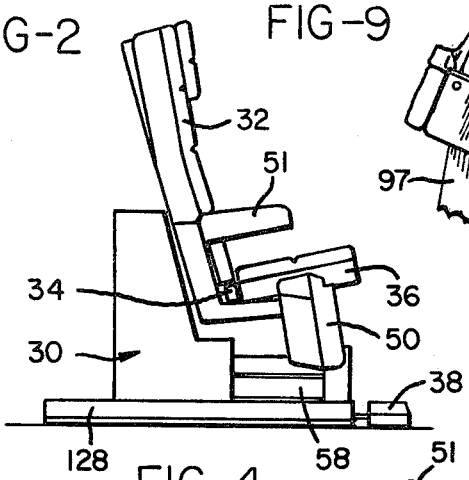
FIG. 2 is a side view of the chair of the present invention in the chair position.

The patient may be seated quite easily in the chair when it is in the chair position shown in FIGS. 1 and 2. After the patient is comfortably seated in the chair and a proper rapport has been established between the physician and patient, the patient is positioned automatically into the lithotomy position illustrated in FIG. 4 by tilting pedal 40 to the left into the "LITHOTOMY ACQUIRE" position. The patient's legs are cradled from the bottom and sides of the calves by leg supports 50 which also include integrally constructed arm rests 51. The seat portion 36 and the intermediate portion 34 of the chair have been lowered into a vertical position. No manual effort is required on the part of the physician in order for the patient to be positioned properly.

Figure 9:
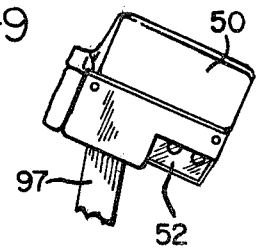
FIG. 9 is a partial side view of the leg support, as oriented in the lithotomy position.

FIG. 9 shows one of the leg supports, as seen from the side closest to the patient. Incorporated within the support 50 is an illuminating lamp 52 which may include several bulbs. The lamps 52 are switched on automatically as the chair moves into the lithotomy position to provide illumination. If desired, the lamps 52 may be switched off by a switch (not shown).

Figure 4:
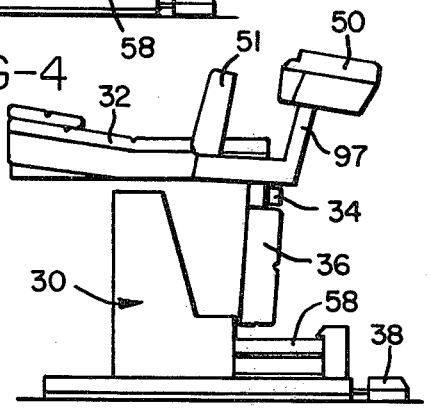
FIG. 4 is a side view of the chair of the present invention in the lithotomy position.
Figure 5:
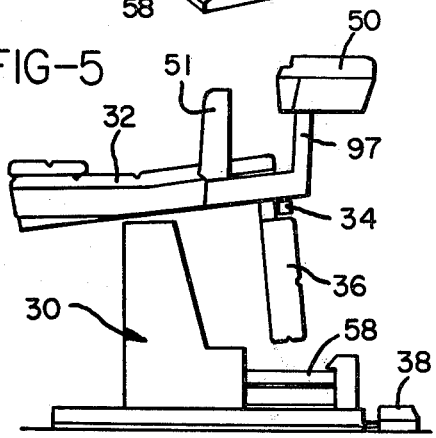
FIG. 5 is a side view of the chair of the present invention in the pelvic tilt position.

From the lithotomy position, shown in FIG. 4, the pelvic tilt position may be achieved by tilting the pedal 42 to the left into its "PELVIC TILT UP" position. The pelvic tilt position of the chair is shown in FIG. 5. This position permits up to two inches of additional pelvic area adjustment with a 10° tilt.

Figure 3:
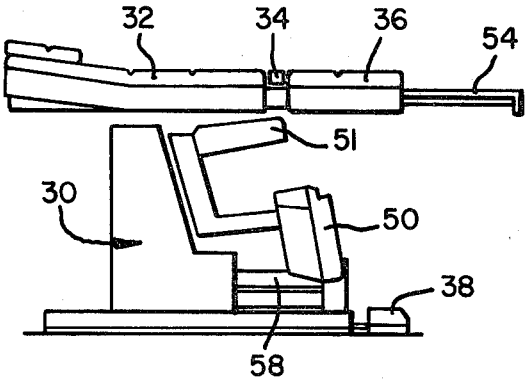
FIG. 3 is a side view of the chair of the present invention in the table position.
Figure 6:
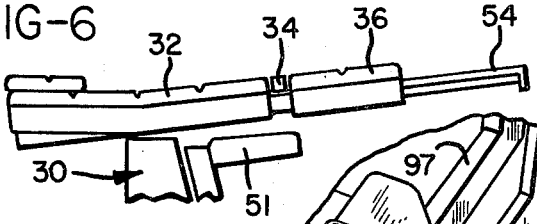
FIG. 6 is a partial side view of the chair of the present invention in the Trendelenberg position.
Figure 8:
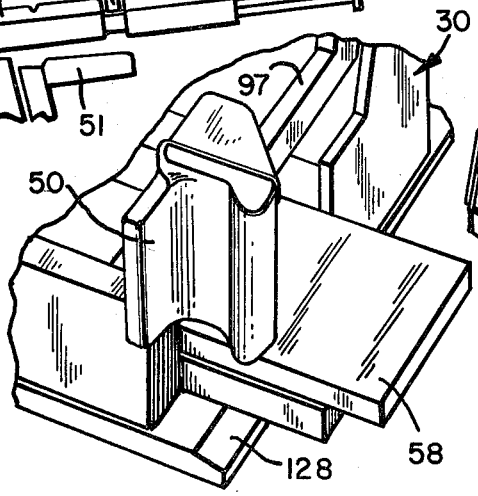
FIG. 8 is a partial perspective view of a portion of the chair, showing a leg support and a slideable step.

The multi-position examination chair may also be moved into a table position, as shown in FIG. 3, by tilting pedal 44 to the left into its "TABLE ACQUIRE" position. In the table position, the back portion 32, the intermediate portion 34 and the seat portion 36 of the chair are positioned to form a substantially flat table surface. An extendable shelf 54 may be manually withdrawn from the end of the seat portion 36 to extend the table surface, if desired. The leg supports 50 and arm rests 51 are manually pivoted downwardly and out of the way when the chair is in the table position. From the table position shown in FIG. 3, the Trendelenberg position of FIG. 6 may be achieved by tilting pedal 42 to the left to the "PELVIC TILT UP" position.

The control arrangement of the present invention is extremely flexible in that the chair may be moved to any of its examination positions from any of the other examination positions without returning to the initial chair position. Additionally, the chair may be returned from the lithotomy or table positions at the completion of the examination by actuating the appropriate one of pedals 40 and 44 to the right to their respective "RETURN" positions.

Should it be desired for the patient to step onto or off of the chair when the chair is in its table or lithotomy positions, a step 58 is provided in the base. The step is mounted to slide out from the base 30 when its use is desired.

Figures 10, 15:
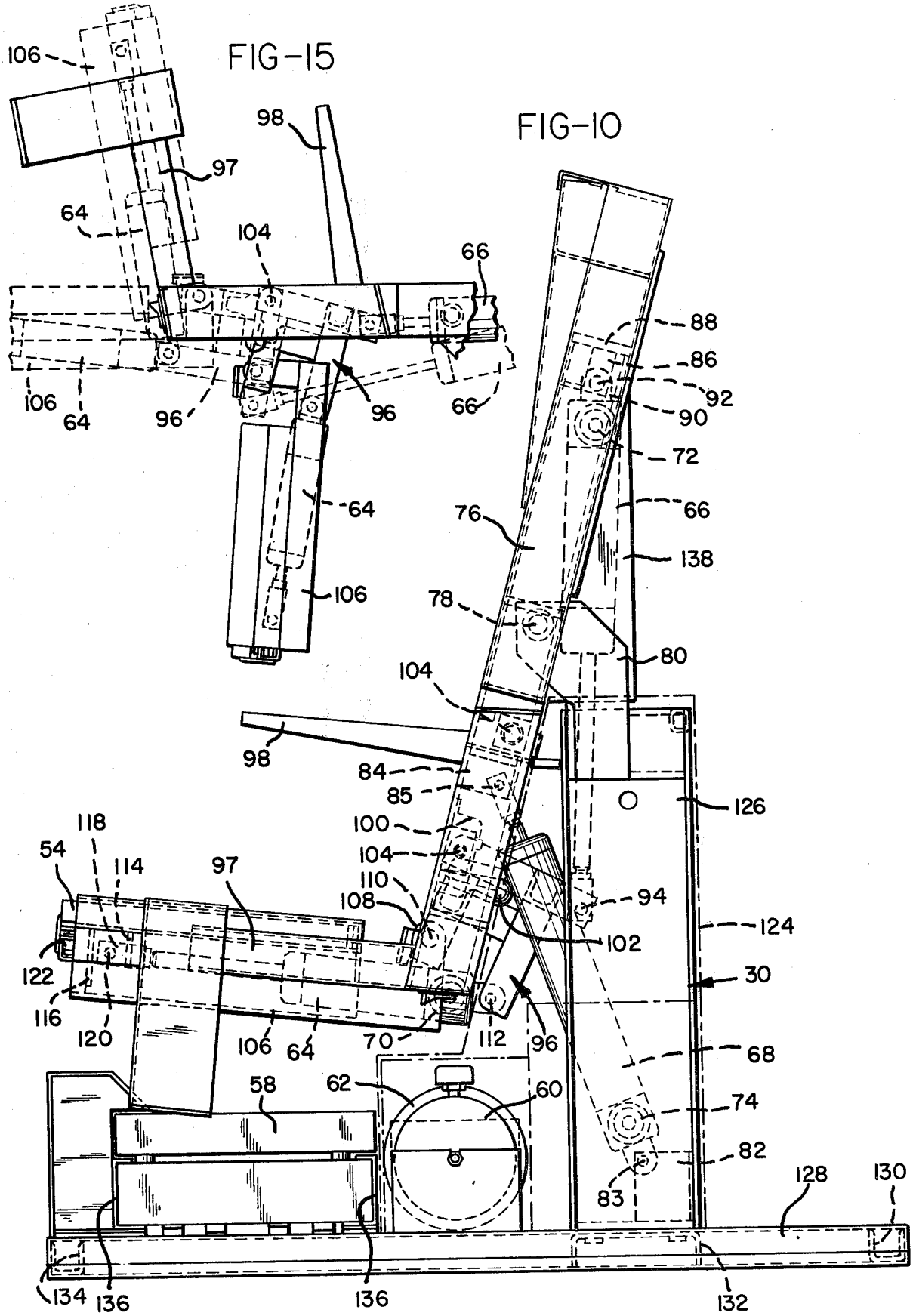
FIG. 10 is a side view of the chair, as seen from the opposite side of the chair with respect to FIG. 2, with the upholstery removed to reveal the underlying support structure.
FIG. 15 is an enlarged partial view, similar to FIG. 12, but with the support structure shown in full lines in the lithotomy position, and in dashed lines in the table position and in an intermediate position.

FIG. 10 is a side view of the multi-position examination chair with the upholstery removed. The chair is positioned by means of a hydraulic pump 60, driven by an electric motor 62, which cooperates with hydraulic cylinder 64, hydraulic cylinder 66, and a pair of cylinders 68, which are positioned in FIG. 10 directly in line so that only one of the cylinders is visible. Flow to each of the cylinders 64, 66, and 68, is controlled by solenoid valves, including valves 70, 72, and 74 which form an integral part of cylinders 64, 66, and 68, respectively. Each of the valves mounted on the cylinders must be opened to allow the cylinder to be extended or retracted. The motor 62 and pump 60 are reversible such that hydraulic fluid can be pumped either to the rod or piston end of the cylinder by changing the direction of rotation of the motor. Thus, by opening and closing the solenoid valves in a predetermined sequence as the pump is rotating in a desired direction, the extension and retraction of the hydraulic cylinders is controlled.

The chair support structure for the back portion of the chair includes a back frame 76 which includes a pair of hinge pins 78 which extend inwardly into a pair of upwardly extending support arms 80. The back frame 76, with the balance of the chair structure attached thereto, pivots about pin 78 under control of the hydraulic cylinders 68. Each cylinder 68 is pivotally attached to a cylinder pivot support 82 by pin 83 at one end of the cylinder and pivotally attached to a bracket 84 by pin 85 at the opposite end of the cylinder. The cylinders 68, therefore, comprise a first cylinder means connected between the base means and the back portion of the chair.

A bracket 86 is mounted on a cross member 88 extending across the back frame. A yoke 90 on the end of cylinder 66 extends on both sides of bracket 86 and has a pin 92 extending therethrough such that a pivot connection is formed. The rod of cylinder 66 is pivotally attached by a pin at 94 to pivot member 96 which forms a part of the intermediate portion of the chair. The leg support structure 97, including integrally formed arm support structure 98, is locked into the position shown by means of a lock mechanism in lock housing 100. The lock mechanism is released by means of a lever 102, extending behind the back frame 76. When released, the leg support structure 97 may pivot about pivot point 104, as hereinafter discussed more fully. Pivot member 96 is pivotally attached to the back frame by pins 104.

The hydraulic cylinder 66 provides a second cylinder means which is connected between the intermediate portion of the chair and the back portion of the chair.

The seat frame 106, providing the support for the seat portion of the chair, includes tabs 108 which are attached pivotally to the pivot member 96 by means of pins 110. Hydraulic cylinder 64 forms a third cylinder means which is connected between the pivot member 96 of the intermediate chair portion at pivot pin 112 and a bracket 114 mounted on cross member 116 in the seat frame 106. The rod end of cylinder 64 is attached to the bracket 114 by means of an attachment yoke 118 and a pin 120 extending through the bracket 114. The seat extension 54 is slideably mounted in the seat frame 106 and is latched in the retracted position shown in FIG. 10 by a latch mechanism 122.

Base 30 includes a base cover 124 which covers a pair of side uprights 126 to which the support arms 80 are fastened. A platform portion 128 of the base 30 includes cross support channels 130, 132 and 134 which provide rigidity and support. Mounted on the platform 128 are step support brackets 136 which guide the step 58 as it is moved into and out of its operative step position. Also providing a cover of the hydraulic components is shroud 138 which is attached to the back of the back frame 76.

Figures 11, 12, 13, 14:
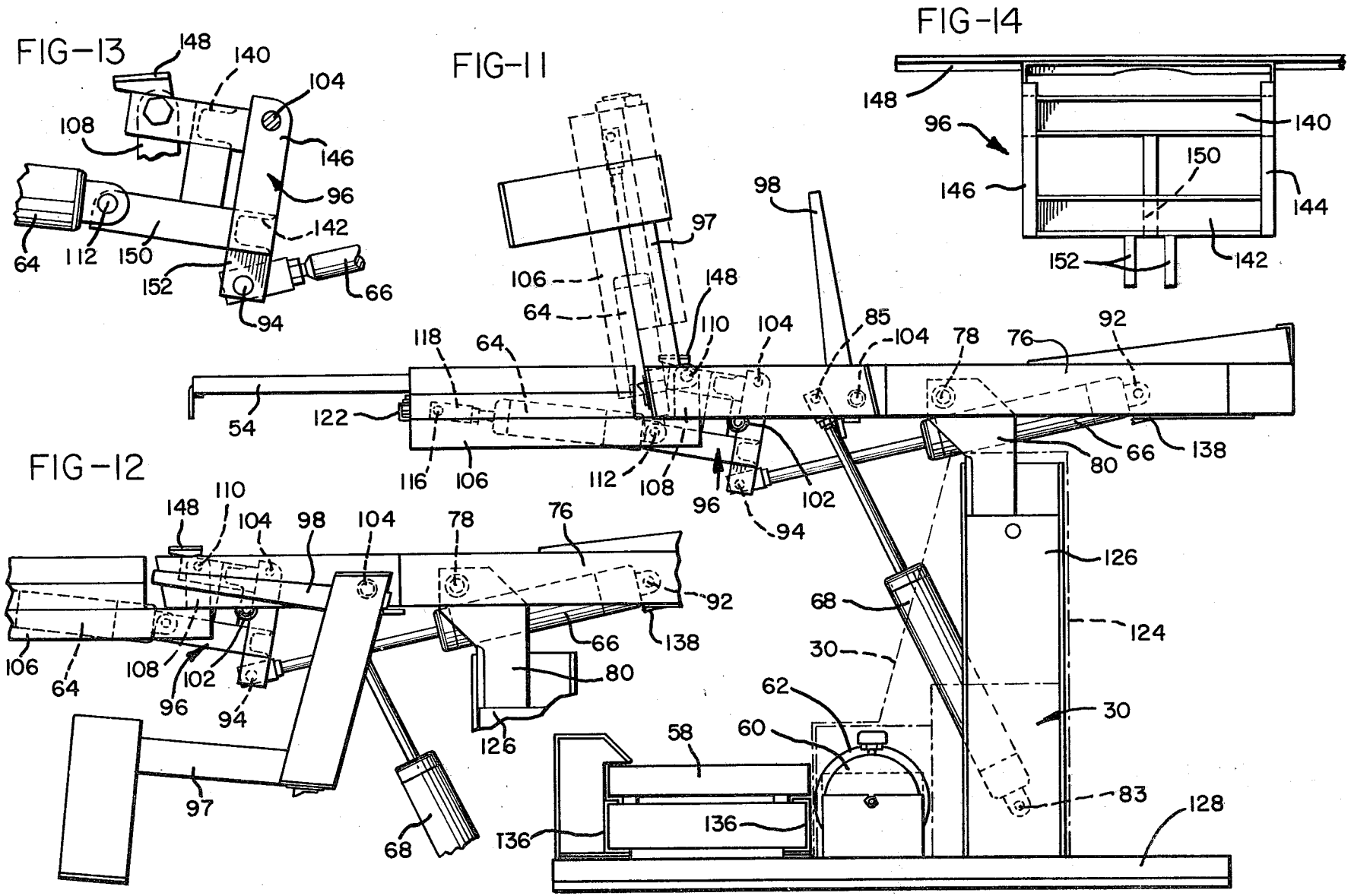
FIG. 11 is a view, similar to FIG. 10, showing the chair support structure in the table position in full lines and an intermediate seat position in dashed lines.
FIG. 12 is an enlarged partial view, similar to FIG. 11, showing the chair support structure in the table position, with the leg supports lowered.
FIG. 13 is an enlarged view of the intermediate chair section of the chair, as it is oriented in the table position.
FIG. 14 is a view of the intermediate chair section of the chair, as seen looking right to left in FIG. 13.

Reference is now made to FIG. 11, a view similar to FIG. 10 but with the chair portions repositioned and with some details of the chair construction omitted in order to clarify the movement of the essential chair components. When the "LITHOTOMY ACQUIRE" function is initiated by actuation of pedal 40 (FIG. 7), cylinders 68 will begin to extend from the fully retracted position shown in FIG. 10, thus pivoting the entire chair about pins 78. The solenoid valves in cylinders 68 will be opened as the motor 62 rotates pump 60 until the position shown in FIG. 11, with the back portion of the chair horizontal, is achieved. At this time, the seat portion of the chair will be in the position indicated by the dashed lines. If pedal 40 continues to be held in the "LITHOTOMY ACQUIRE" position, cylinder 64 will then begin to retract, moving the seat portion into the position shown by the full lines in FIG. 11. Cylinder 66 will then retract until the lithotomy position is achieved. The final lithotomy position is illustrated in FIG. 15 in full lines, with the position of the seat portion and the intermediate portion of the chair shown in dashed lines prior to actuation of the cylinder 64 and also prior to actuation of the cylinder 66. In going from the intermediate position shown in dashed lines in FIG. 11 to the position shown in full lines in FIG. 11, the seat frame 106 will pivot about pins 110. As seen in FIG. 15, in order for the final lithotomy position to be achieved, the seat portion of the chair and the intermediate portion of the chair will then be pivoted together by cylinder 66 about pins 104, with the relative position of the seat portion including seat frame 106 and the intermediate portion including pivot member 96 remaining unchanged.

When it is desired to return to the chair position from the lithotomy position, the physician tilts the pedal 40 to the right to its "LITHOTOMY RETURN" position and the hydraulic cylinders 64, 66 and 68 will extend or retract in the opposite order from that in which they were operated in reaching the lithotomy position.

FIG. 12 illustrates the relative position of the back, intermediate and seat portions of the chair when the chair is placed in the table position. As noted by comparing FIGS. 11 and 12, the chair passes through the table position as it moves into the lithotomy position. When the physician tilts pedal 44 to the left into its "TABLE ACQUIRE" position, the cylinders 68 will extend until the back portion of the chair is horizontal. At this time, the cylinder 64 will begin to retract until the back, intermediate, and seat portions of the chair form the horizontal table surface desired. The cylinder 66 will not be retracted and, therefore, the seat portion and intermediate portion of the chair will remain in line with the back portion. The physician may then manually release the leg support structure lock mechanism with lever 102 and pivot the leg support structure 97 and the arm support structure 98 about pins 104 such that they are out of the way, as shown in FIG. 12. The seat extension 54 is then released and pulled out of seat frame 106 if a table of additional length is desired. Prior to returning the chair to the chair position, the seat extension 54 will be manually pushed into its retracted position in the seat frame 106 and the leg rests pivoted upwardly into the position shown in FIG. 11. The "TABLE RETURN" position of pedal 44 will then operate cylinder 64 and cylinders 68 to return the chair to its chair position.

FIGS. 13 and 14 are enlarged side and end views of the intermediate portion of the chair with the upholstery removed. For the sake of clarity, the hydraulic cylinders and the tabs 108 of the seat frame are omitted from FIG. 14. The pivot member 96 includes a pair of channel shaped cross members 140 and 142 which extend between side members 144 and 146. Upholstery support member 148 extends across the side members 144 and 146. A cylinder support 150 is attached to the channel members 140 and 142 and is pivotally connected by pin 112 to the cylinder 64. A pin 94 forms a pivotal connection between the rod of cylinder 66 and tabs 152.

With the chair positioned in either the lithotomy position or the table position, the tilt pedal 42 may be actuated to its "TILT UP" position. If the chair is in the lithotomy position, the pelvic tilt position, shown in FIG. 5, will be achieved. If the chair is in the table position, the Trendelenberg position shown in FIG. 6 will be achieved. The tilting action of the chair into the Trendelenberg and pelvic tilt positions is accomplished by a further extension of cylinders 68, thus pivoting the entire chair about pins 78. Actuation of the pedal 42 into its "TILT DOWN" position will result in the retraction of the cylinders 68 and the return of the chair to a position in which its back portion is horizontal.

Figure 16:
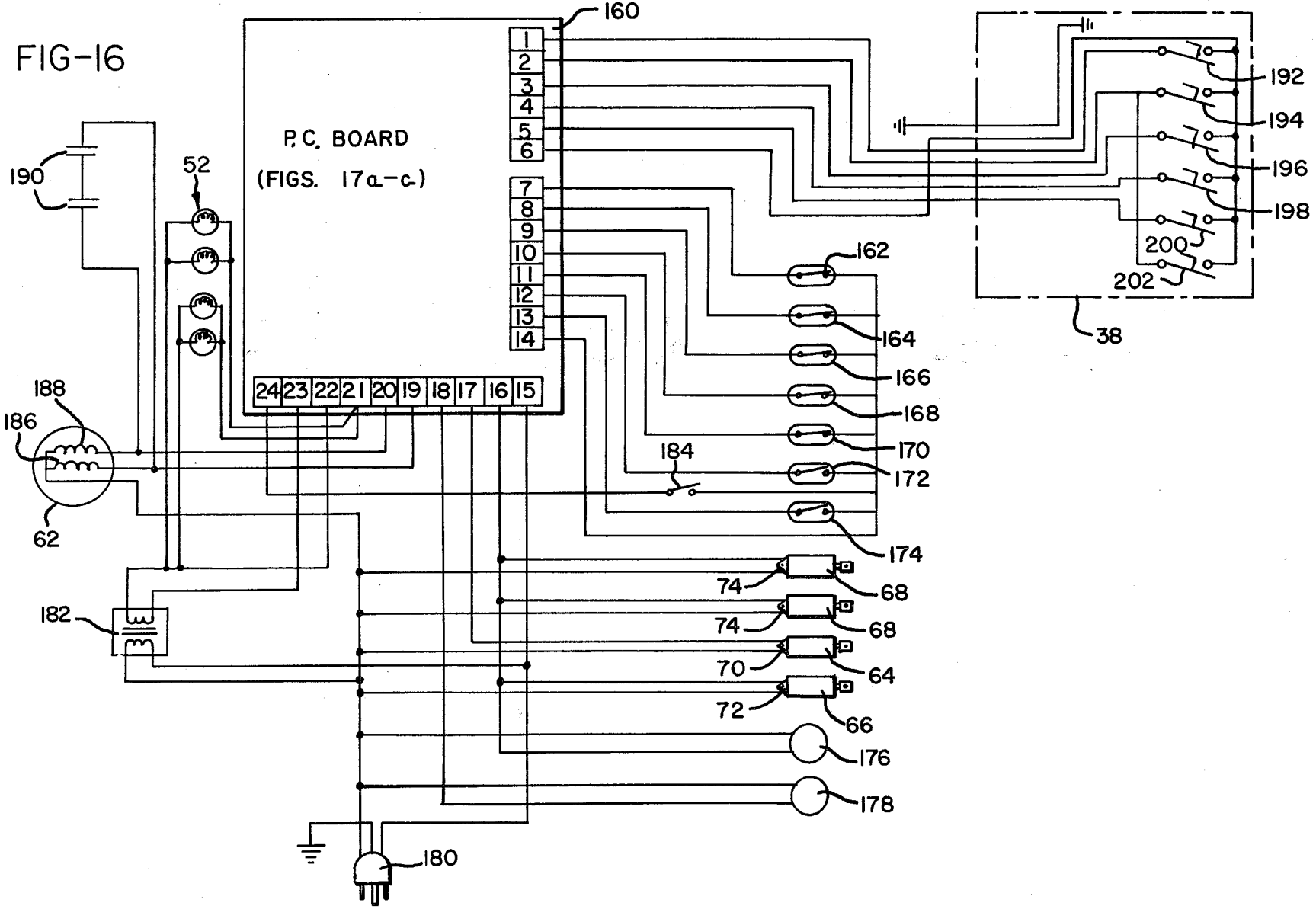
FIG. 16 is a schematic representation of a portion of the electrical control circuit of the present invention.

FIG. 16 illustrates the electrical circuitry which controls operation of the hydraulic power systems as it moves the chair into various positions. The logic circuit is mounted on printed circuit board 160 and is electrically connected to the balance of the circuit of FIG. 16 by connectors 1–24. Reed switches 162–174 are mounted on the hydraulic cylinders which power the movement of the chair portions. A ceramic magnet is mounted on the piston in each of the cylinders and, the switching state of a reed switch therefore provides an indication of the position of the piston and rod of the cylinder upon which it is mounted.

Reed switches 162 and 164 are mounted on one of the base cylinders 68, with switch 162 being positioned to close when these cylinders are retracted and reed switch 164 being positioned to close as the cylinders are extended and the back portion of the chair reaches a horizontal position. Reed switches 166 and 168 are mounted on hydraulic cylinder 64, with switch 166 positioned to close when the cylinder is extended and switch 168 positioned to close when the cylinder is retracted. Reed switches 170 and 172 are positioned on hydraulic cylinder 66 such that reed switch 170 is closed when the cylinder 66 is extended and reed switch 172 is closed when it is retracted.

Reed switch 174 is also positioned on one of cylinders 68 such that it will close when the cylinder 68 has been extended to place the chair in a tilt position and then retracted, returning the chair to its non-tilted orientation. Switch 174 is needed, in addition to switch 164, since switch 164 would not be closed by the retraction of the cylinder 68 as the chair is returned from a tilt position until after the chair had passed through a position in which the back portion of the chair is horizontal.

Hydraulic cylinders 64, 66 and 68 are represented diagrammatically in FIG. 16 and include solenoid actuated valves 70, 72 and 74, respectively. Anti-cavitation valves are provided in the hydraulic supply lines to cylinders 68 and hydraulic cylinder 66, as described below in the description of the hydraulic circuit. Solenoid coils 176 and 178 are provided to actuate these valves in the hydraulic lines of cylinder 68 and 66, respectively.

Electric power for the system is provided via plug 180, which is connected to a conventional 115 volt, 60 Hz electrical outlet. Transformer 182 steps down this supply current to twelve volts for use by the logic circuit on board 160.

Lamps 52 in the leg rests are actuated automatically as the chair is moved into its lithotomy position. These lamps may, however, be disabled by opening switch 184.

Motor 62 is a bi-directional motor and is rotated in a first direction or a second direction when one of coils 186 and 188 is energized. Starting capacitors 190 are provided to assist the motor 62 in starting.

Foot-actuatable control 38 includes a plurality of switches which, as described above, are actuated by tilting a control pedal in the appropriate direction. Switch 192 controls the LITHOTOMY ACQUIRE function; switch 194 controls the LITHOTOMY RETURN function; switch 196 controls the TILT UP function; switch 198 controls the TILT DOWN function; switch 200 controls the TABLE ACQUIRE FUNCTION; and switch 202 controls the TABLE RETURN function. As is clear, control input information is supplied to the logic control circuitry on board 160 through connectors 1–14 and 24 and control output signals from the board 160 are provided through connectors 15–21.

Figure 17A:
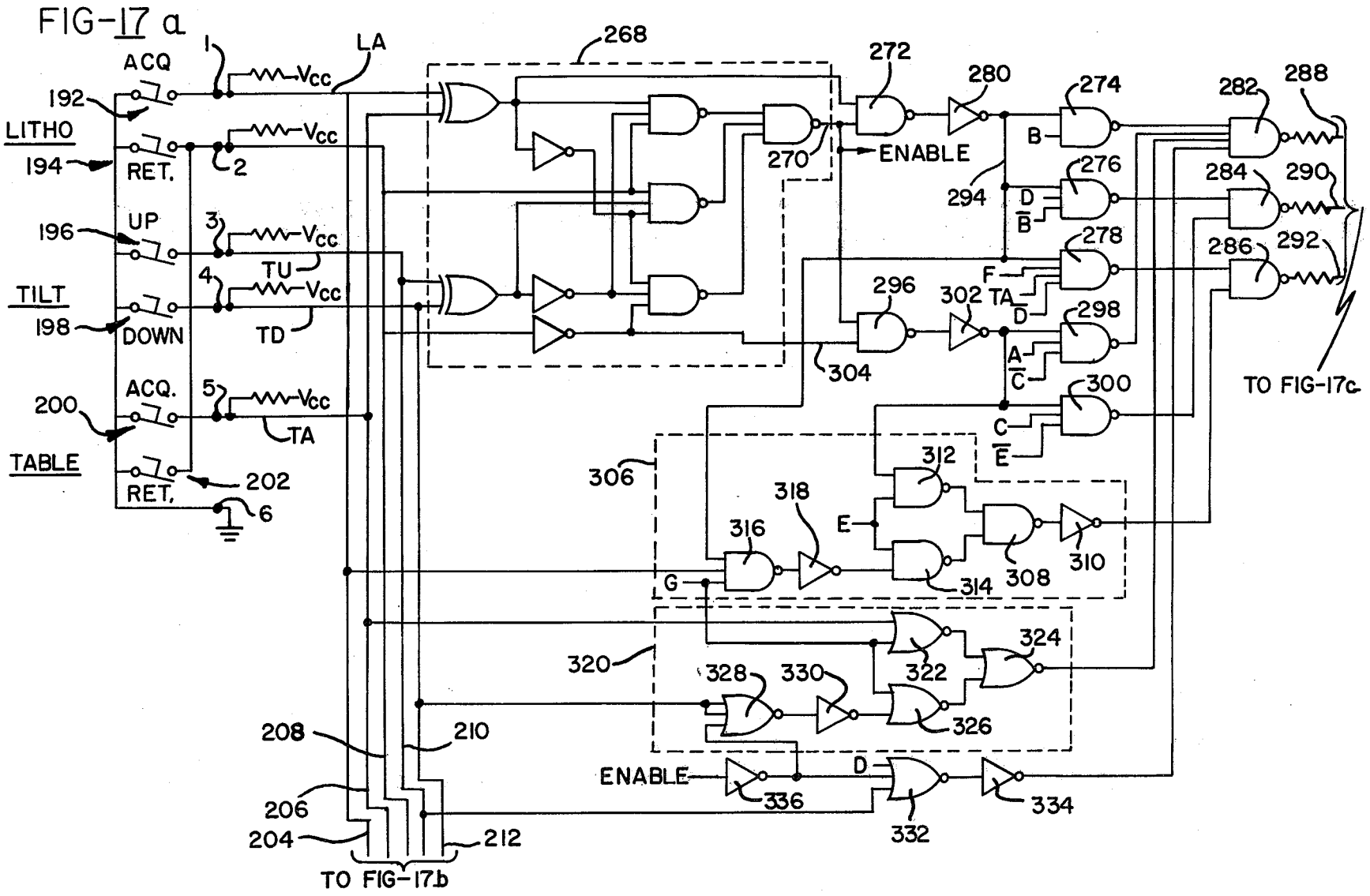
FIGS. 17A, 17B, and 17C, when assembled as shown in FIG. 18, form a schematic representation of the control logic circuitry which is mounted on the printed circuit board of FIG. 16.
Figure 17B:
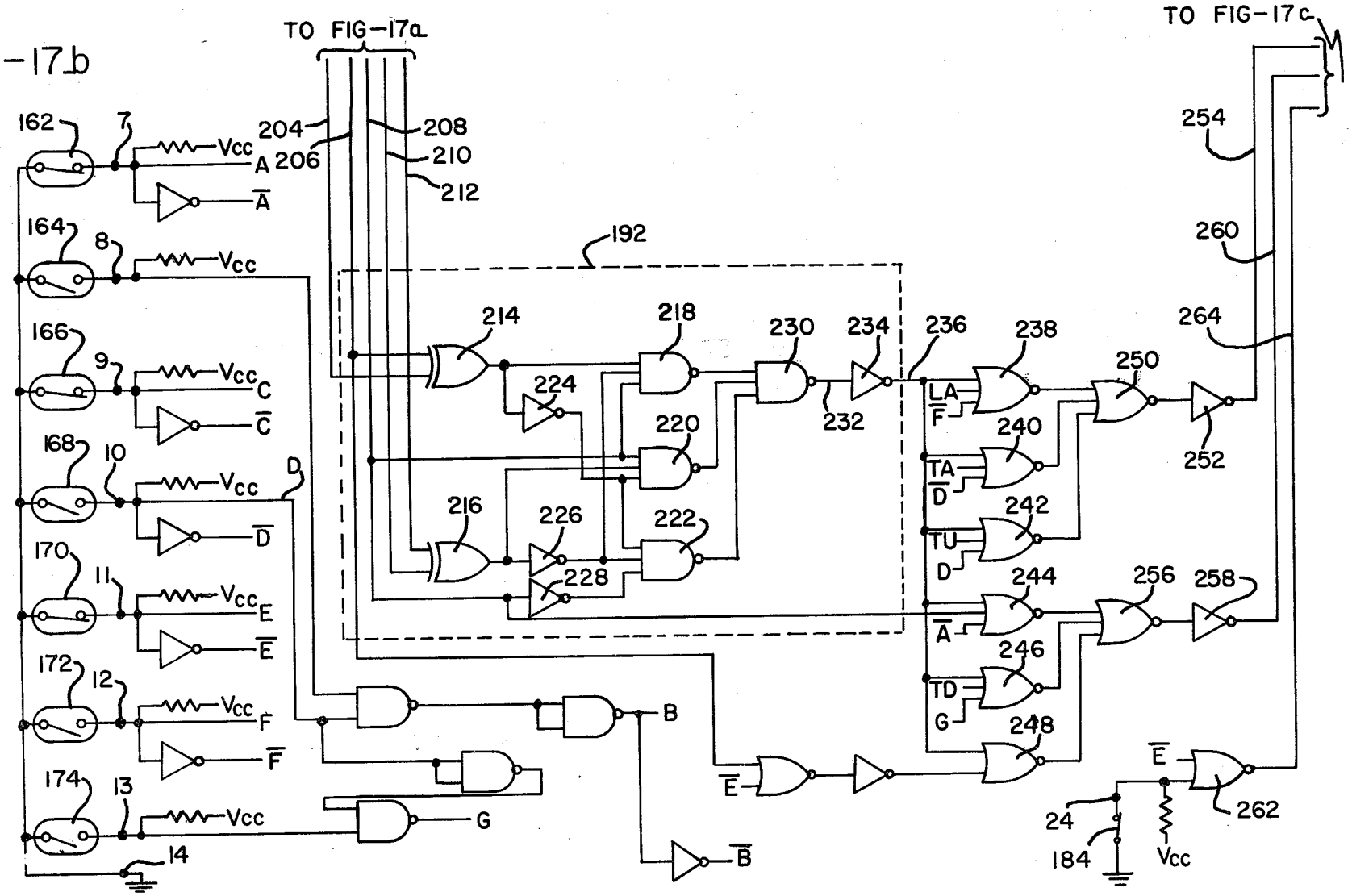
Figure 17C:
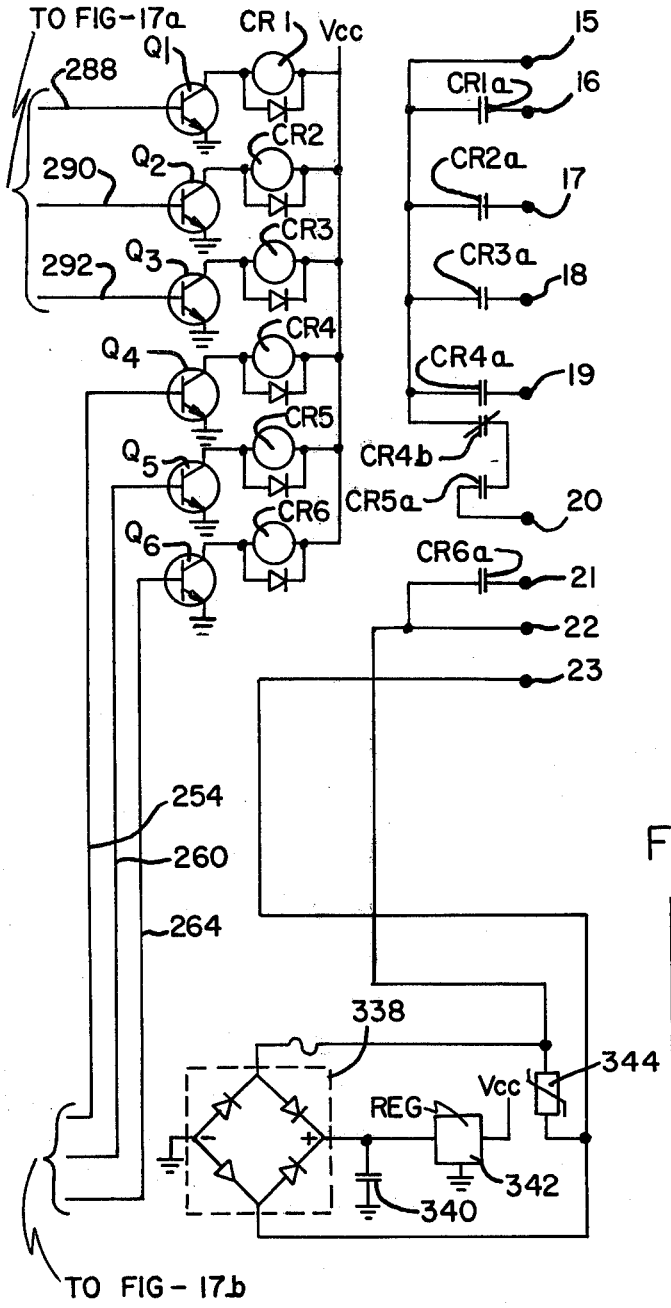
Figure 18:
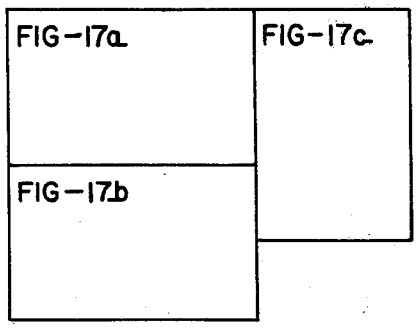

Reference is now made to FIGS. 17A–17C which, when assembled as shown in FIG. 18, illustrate schematically the control logic of the present invention. Nodes 1–24 correspond to the connectors 1–24 of FIG. 16. The logic shown in FIG. 17A relates generally to the control of the hydraulic cylinders, while most of the logic shown in FIG. 17B controls the motor 62 and the lamps 52. The circuitry of FIG. 17C, in general, provides the output control signals, as well as the twelve volt DC supply voltage.

An interlock and enable circuit 192, shown in FIG. 17B, is responsive to the LITHOTOMY ACQUIRE signal on line 204, the TABLE ACQUIRE signal on line 206, the LITHOTOMY RETURN signal on line 208, the TILT UP signal on line 210, and the TILT DOWN signal on line 212. It should be noted that the TABLE RETURN signal is also applied to line 208.

EXCLUSIVE OR gate 214 provides an output only when one but not both of the LITHOTOMY ACQUIRE and TABLE ACQUIRE signals are provided. Similarly, EXCLUSIVE OR gate 216 provides an output when one but not both of the TILT UP and TILT DOWN signals are received. NAND gates 218, 220, and 222 are connected with INVERTERS 224, 226, and 228, and EXCLUSIVE OR gates 214 and 216, such that NAND gate 230 will not receive all "0's" on its inputs, and thus provide a "1" on line 232, when one and only one of the RETURN, TILT, and ACQUIRE functions is chosen by actuation of the appropriate switch. This ENABLE signal on line 232 is then inverted by INVERTER 234 and supplied to line 236.

NOR gates 238, 240, 242, 244, 246, and 248, are enabled by a "0" signal on line 236. NOR gate 250 and INVERTER 252 act as an OR gate to provide a signal to line 254 which will cause the motor 62 to rotate in a first direction. Similarly, NOR gate 256 and INVERTER 258 act as an OR gate to provide a signal to line 260 which will cause the motor 62 to rotate in a second direction.

NOR gate 238 will provide a "1" output when the LITHOTOMY ACQUIRE function is chosen and the $\overline{F}$ signal is "0", which indicates that the reed switch 172 is not closed. Since reed switch 172 will only close when the cylinder 66 is fully retracted and the lithotomy position reached, line 254 will continue to be energized until the lithotomy position is attained.

NOR gate 240 will provide a "1" output when the TABLE ACQUIRE function is chosen and $\overline{D}$ signal is "0", indicating that the reed switch 168 is not closed. Reed switch 168 will close when cylinder 64 is retracted and the table position is reached.

NOR gate 242 will provide a "1" output only when the TILT UP function is chosen and the D signal is "0", indicating that reed switch 168 is closed. Reed switch 168 will be closed only when cylinder 64 has been retracted and the chair, therefore, is in either the table position or the lithotomy position.

NOR gate 244 will provide a "1" output only when the LITHOTOMY RETURN or TABLE RETURN function is selected and the $\overline{A}$ signal is "0", indicating that reed switch 162 is not closed. Reed switch 162 will be open when cylinders 68 are not retracted completely. When the cylinders 68 have retracted completely, of course, the return operation will have been completed and the chair will be in its chair position.

NOR gate 246 will provide a "1" output only when the TILT DOWN function is chosen and the G signal is "0". The G signal will only be "0" when the reed switch 174 is open, indicating that the back portion of the table is not yet horizontal and, at the same time, when the reed switch 168 is closed, indicating that the cylinder 64 has been retracted and that, therefore, the table is either in its table or lithotomy positions.

Finally, NOR gate 248 will provide a "1" at its output only when the chair is to be moved from its lithotomy position to its table position. This will occur when the TABLE ACQUIRE function is chosen and the TABLE ACQUIRE signal on line 206 is "0" and, simultaneously, the $\overline{E}$ signal is "0", indicating that the reed switch 170 is not closed as is the case when the cylinder 66 is not completely extended.

NOR gate 262 will provide a "1" signal to line 264, causing lamps 52 to be energized, when the $\overline{E}$ signal is "0". The $\overline{E}$ signal will be "0" when the reed switch 170 is not closed, indicating that the cylinder 66 has begun to retract and that the chair is moving into the lithotomy position. The NOR gate 262, in order to provide a "1" signal on its output 264 must also receive a "0" signal from ground via switch 184. Should it be desired to disable the lamps 52, switch 184 may simply be opened.

Interlock and enable circuit 268, is similar to circuit 192 in FIG. 17B, with the exception that an INVERTER is not provided in the output. The details of this circuit will, therefore, not be discussed. Circuit 268 will provide a "1" output on line 270 at the same time that a "1" is applied to line 232 in circuit 192. That is, line 270 will receive a "1" when one and only one of the RETURN, TILT, and ACQUIRE functions is selected.

NAND gates 272, 274, 276, and 278, along with INVERTER 280, form an "ACQUIRE" circuit which will enable one of NAND gates 282, 284, and 286 when an ACQUIRE function is selected and circuit 268 simultaneously provides an ENABLE signal at its output 270. As is described below, when NAND gate 282 receives a "0" on any of its inputs, it will provide a "1" on its output 288 which will result in hydraulic fluid being applied to cylinders 68. When NAND gate 284 receives a "0" on any of its inputs, it will provide a "1" on its output 290 which will result in hydraulic fluid being applied to cylinder 64. Similarly, when NAND gate 286 receives a "0" on any of its inputs, it will provide a "1" on its output 292 which will result in hydraulic fluid being applied to cylinder 66. It should be understood, of course, that the direction of movement of the various cylinders will be dependent upon the direction in which pump 60 is being rotated by motor 62.

INVERTER 280 will provide "1" signal to line 294 when an ACQUIRE function is chosen and, simultaneously, an ENABLE signal is provided by circuit 268. NAND gate 274 will provide a "0" at its output when B is a "1", indicating that both of reed switches 164 and 168 are open. This will occur only when the cylinder 64 is extended and cylinders 68 are retracted, which in turn occurs only when the chair is in its chair position.

NAND gate 276 will provide a "0" on its output only when the D signal is "1" and the $\overline{B}$ signal is also "1". This condition will only occur when the cylinders 68 have extended such that the back portion of the chair is horizontal and the cylinder 64 has not yet retracted.

Finally, NAND gate 278 will provide a "0" output when the F signal, the TA signal and the $\overline{D}$ signal are all "1's". Thus NAND gate 278 will provide a "0" output when the LITHOTOMY ACQUIRE function is chosen, the cylinder 64 has retracted, and the cylinder 66 has not yet retracted. The TA signal will be "1" when the TABLE ACQUIRE function is not selected. Since line 294 will be "1" only when an ACQUIRE function is chosen, the coincidence of a "1" on line 294 and a "1" for the TA signal indicates that the LITHOTOMY ACQUIRE function has been chosen.

NAND gates 296, 298, and 300, along with INVERTER 302, form a circuit controlling return of the chair from the table position to chair position. This circuit will provide a "0" to one of NAND gates 282 and 284 when a RETURN function is selected. A "1" is provided on line 304 to NAND gate 296 whenever a RETURN function is chosen. INVERTER 302 therefore provides a "1" signal to gates 298 and 300 when an ENABLE signal is provided from circuit 268 and, simultaneously, a RETURN function is chosen.

NAND gate 298 will provide "0" at its output when the A signal is a "1" and, simultaneously, the $\overline{C}$ signal is a "1". This will occur when the reed switch 162 is open, indicating that the cylinders 68 are not retracted and, simultaneously, when reed switch 166 is closed, indicating that the cylinder 64 is extended.

NAND gate 300 will provide a "0" output when the C signal and the $\overline{E}$ signal are both "1". This will occur when the reed switch 166 is open, indicating that the cylinder 64 is not retracted and when the reed switch 170 is closed, indicating that the cylinder 66 is extended.

Circuit 306 provides the control signal to NAND gate 286 when it is desired to return the chair from the lithotomy position to the table position. NAND gate 308 and INVERTER 310 act as an AND gate to provide a "0" to NAND gate 286 when the output of either NAND gate 312 or NAND gate 314 is "0".

NAND gate 314 will provide a "0" output when the following conditions are met. The E signal must be "1", indicating that the cylinder 66 is not extended. Additionally, the NAND gate 314 must receive a "1"0 from NAND gate 316 and INVERTER 318. This will occur when the line 294 has a "1" signal on it, indicating that an ACQUIRE function has been chosen, line 204 has a "1" signal on it indicating that the LITHOTOMY ACQUIRE function is not chosen, and the G signal is "1". The G signal will be "1", in turn, except when the reed switch 168 is closed, indicating that cylinder 64 is retracted and reed switch 174 is open, indicating that the chair back portion has not been returned to its horizontal position.

The NAND gate 308 and INVERTER 310 will also provide a "0" output to NAND gate 286 if NAND gate 312 has a "0" output. NAND gate 312 will provide a "0" output when both the E signal and the output of INVERTER 302 are "1's". This, in turn, will occur when the reed switch 170 is open, indicating that cylinder 66 is not extended, and, simultaneously, the output of INVERTER 302 is a "1" indicating that a RETURN function has been chosen.

Circuit 320 will provide a "0" output to NAND gate 282 when the TILT DOWN function is selected or the TABLE ACQUIRE function is selected and the chair is appropriately positioned in either the Trendelenberg or pelvic tilt positions. Circuit 320 includes NOR gates 322, 324, 326, 328, and INVERTER 330. Similarly, NOR gate 332 and INVERTERS 334 and 336 will provide a "0" to NAND gate 282 when the TILT up function is selected and the chair is positioned in either the lithotomy or table position. It should be noted that NAND gate 282 is enabled in either the TILT UP or TILT DOWN mode of operation, since the direction of movement of cylinders 68 is dependent only upon the direction of of rotation of the hydraulic pump 60.

The circuit shown in FIG. 17C provides the output logic signals for control of the operation of the chair of the present invention. Transistor Q1 is turned on by a "1" signal on line 288, with the result that the coil of relay CR1 will be energized, closing contacts CR1a and energizing the solenoid coils of the solenoid valves 74 associated with cylinders 68. The transistor Q2 will be turned on when a "1" signal is received on line 290, with the result that the relay coil CR2 will be energized. This, in turn, will close contacts CR2a and thus provide an energizing signal to the solenoid valve 70 associated with the cylinder 64. Transistor Q3 will be turned on by a "1" signal on line 292, which will energize relay coil CR3. When relay coil CR3 is energized, contacts CR3a will close, energizing the coil of the solenoid valve 72 associated with cylinder 66.

Transistors Q4 and Q5, when turned on, will energize coils CR4 and CR5, respectively. When relay coil CR4 is energized, contact CR4a will close and the motor 62 will be connected such that winding 186 is energized and the motor is rotated in a first direction. At the same time, contacts CR4b will be opened, thus precluding simultaneous energization of coils 188 and 186 (FIG. 16). When coil CR5 is energized the contacts CR5a will close, energizing winding 188 and causing motor 62 to rotate in a second direction.

Transistor Q6 controls energization of relay coil CR6, which in turn controls closure of relay contact CR6a. The lights 52 are energized when contacts CR6a are closed. The diode bridge 338, capacitor 340, and regulator 342, along with varistor 344 provide the 12 volt d.c. Vcc bias potential for the logic circuitry.

Figure 19:
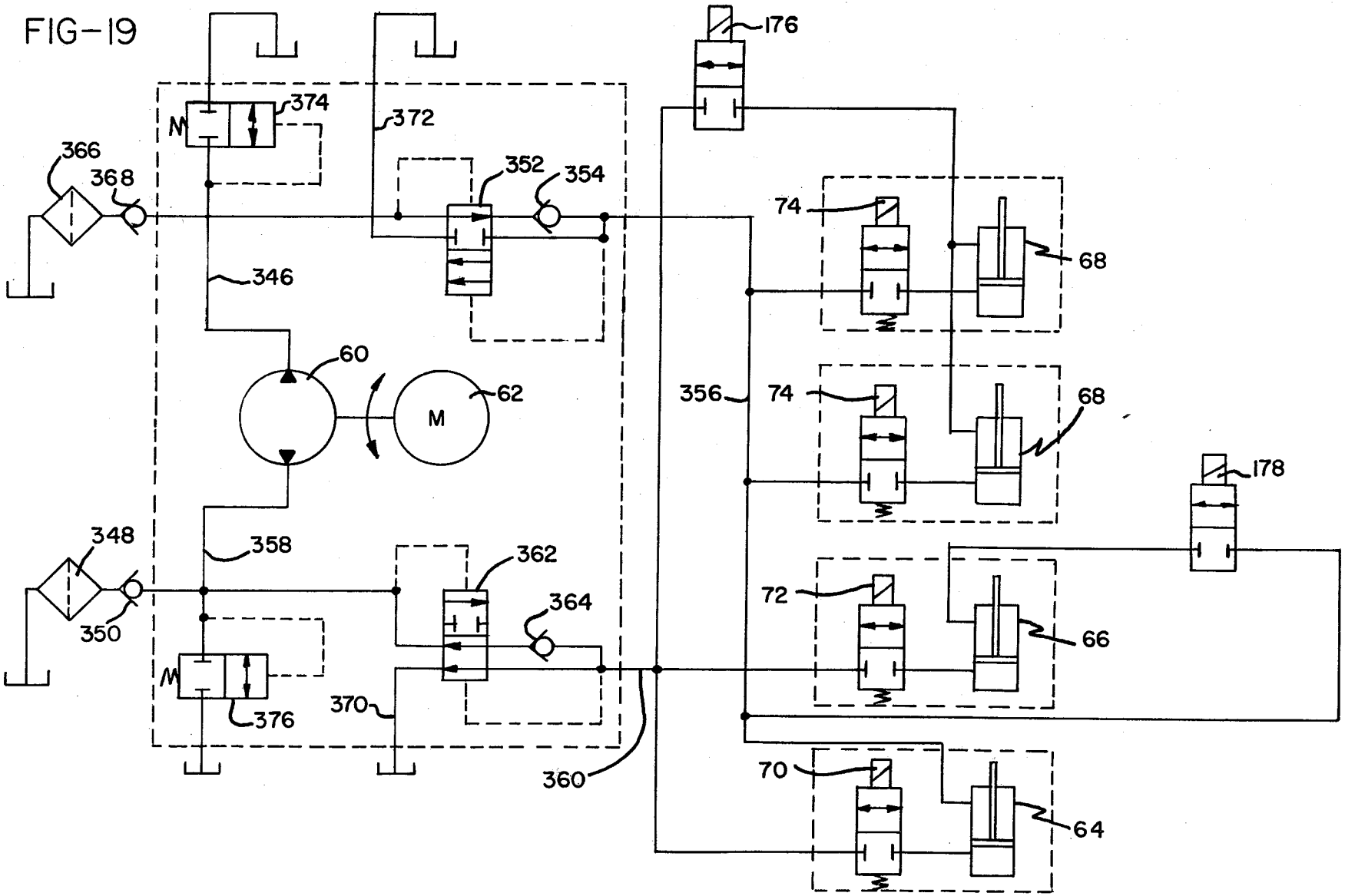
FIG. 19 is a schematic representation of the hydraulic circuit of the present invention.

FIG. 19 illustrates schematically the hydraulic circuit which operates the chair of the present invention. When motor 62 rotates pump 60 in a first direction, line 346 will receive hydraulic fluid which is withdrawn from the fluid reservoir through filter 348 and check valve 350. The hydraulic fluid will be supplied through the pilot operated valve 352 and check valve 354 to line 356. When line 356 receives hydraulic fluid and solenoid valve 70 is actuated, the cylinder 64 will be retracted. When the solenoid valves 74 are actuated and, simultaneously, anti-cavitation valves 176 is actuated, the cylinder 68 will be extended. When solenoid valve 72 is actuated and, simultaneously, anti-cavitation valve 178 is actuated, the cylinder 66 will be retracted.

In like manner, rotation of the pump 60 in a second direction by means of motor 62 will result in hydraulic fluid being applied to line 358. Hydraulic fluid will then be applied to line 360 via pilot operated valve 362 and check valve 364 from the fluid reservoir through filter 366 and check valve 368. When line 360 receives hydraulic fluid, cylinders 68 may be extended and cylinders 64 and 66 may be retracted if the appropriate ones of solenoid valves 70, 72, 74, 176 and 178 are actuated.

Lines 370 and 372 provide return paths for the hydraulic fluid. Pilot operated valves 374 and 376 prevent over pressurization of lines 346 and 358.

While the apparatus described herein constitutes the preferred embodiment of the invention, it is to be understood that the invention is not limited to this precise form of apparatus, and that changes may be made therein without departing from the scope of the invention.

What is claimed is:

1. A multi-position examination chair for supporting a patient and assuming selected ones of a plurality of examination positions which permit a plurality of standard obstetric and gynecologic examinations to be performed upon the patient, comprising:

base means for providing support, a chair mounted on said base means including a back portion supported by and pivotally attached to said base means, an intermediate portion supported by and pivotally attached to said back portion, and a seat portion supported by and pivotally attached to said intermediate portion, a plurality of power means for moving each of said chair portions into desired relative positions such that said plurality of examination positions may be achieved, a plurality of switch means, each such switch means associated with a respective one of said plurality of examination positions, and control means, responsive to said plurality of switch means, for controlling operation of said power means such that actuation of each of said switch means results in the chair portions moving into the examination position associated with the actuated switch means.

2. The examination chair of claim 1, in which said plurality power means comprises a plurality of cylinder means.

3. The examination chair of claim 1, in which said plurality of switch means comprises a plurality of foot-actuated electrical switches.

4. The examination chair of claim 2 in which a first cylinder means extends between said base means and said back portion to effect relative pivotal movement therebetween, a second cylinder means extends between said back portion and said intermediate portion to effect relative pivotal movement therebetween, and a third cylinder means extends between said seat portion and said intermediate portion to effect relative pivotal movement therebetween.

5. The examination chair of claim 4 in which said control means comprises means for sequentially actuating said first, second, and third cylinder means in selected sequences such that only one of said cylinder means is actuated at a time as said examination chair portions are moved into the examination position associated with the actuated one of said plurality of switch means.

6. The examination chair of claim 1 further comprising an integral member forming both an arm rest and a leg support, which integral member is pivotally attached to said back portion and which member may be pivoted into and out of an operative position with respect to a patient supported by said examination chair.

* * * * *